United States Patent [19]

Bergson et al.

[11] 3,989,121

[45] Nov. 2, 1976

[54] PULSE CONVERTING EXHAUST SILENCING SYSTEM

[75] Inventors: Arnold A. Bergson, Ann Arbor; Ralph J. Haren, Jackson; Donald A. Pelton, Grass Lake, all of Mich.

[73] Assignee: Tenneco Inc., Racine, Wis.

[22] Filed: May 14, 1975

[21] Appl. No.: 577,408

[52] U.S. Cl. ..... 181/35 B; 181/36 D; 181/57

[51] Int. Cl.[2] ..... F01N 1/00; F01N 5/00

[58] Field of Search ..... 181/61, 35 B, 35 C, 181/40, 49, 53, 54, 57, 58, 36 D

[56] References Cited

UNITED STATES PATENTS

| | | | |
|---|---|---|---|
| 2,184,891 | 12/1939 | Bourne | 181/59 |
| 2,675,088 | 4/1954 | McLeod | 181/53 UX |
| 3,243,011 | 3/1966 | Hill | 181/58 |
| 3,327,809 | 6/1967 | Walker | 181/61 UX |
| 3,692,142 | 9/1972 | Stemp | 181/66 X |
| 3,807,527 | 4/1974 | Bergson et al. | 181/35 B |

*Primary Examiner*—John Gonzales
*Attorney, Agent, or Firm*—Harness, Dickey & Pierce

[57] ABSTRACT

A silencing system for the exhaust gas of internal combustion engines or the like, and particularly diesel engines, wherein the system has means to convert high energy exhaust pulses found along the length of the silencing system into more or less standard pulses which means includes compliance devices located at points of minimum compliance, inertance devices at points of maximum compliance, and a manifold volume at a point adjacent the engine manifold where a point of minimum compliance occurs.

3 Claims, 4 Drawing Figures

PULSE CONVERTING EXHAUST SILENCING SYSTEM

BACKGROUND OF THE INVENTION

All internal combustion engines generate a series of discrete exhaust pressure pulses whose basic characteristics of peak amplitude, waveshape, and repetition rate depend on the type of engine, the speed and the load. Conventional four cycle reciprocating piston engines of the type ordinarily used in automobiles exhibit a field of pulses having, from the standpoint of sound attenuation, relatively desirable characteristics in that the waveshapes are relatively symmetrical or sinusoidal, the peak to average pressure ratios are moderate, and the higher harmonic amplitudes decrease rapidly with increases in frequency. This is due to the relatively high engine RPMs and light load on those engines under normal operating conditions. In general, the exhaust gas discharged by these piston engines has been satisfactorily silenced by apparatus derived from classical methods of analysis assuming a linear sound field.

Other engines, however, such as diesel engines for trucks, generate high energy pulses which appear to be N-shaped, with extremely high peak and peak to average pressures, with very unfavorable dissymmetries causing a flat frequency-pressure response, and an unusually large number of acoustically significant notes. In the case of truck engines, the overall noise level is considerable and the nodal/anti-nodal characteristics of the exhaust system conduits virtually disappear. Thus, the usual standing wave theory of exhaust silencing is not satisfactory and truck engines have presented a significantly new exhaust gas silencing problem requiring a new approach for solution. This problem becomes more acute as engine RPM limiting devices are advanced downwardly to accommodate reductions in maximum road speeds.

BRIEF SUMMARY OF THE INVENTION

It is the purpose of the invention to provide an exhaust gas silencing system for truck type engines and for other internal combustion engines or fluid propelling units that discharge high energy or shock-like gas pulses which are very difficult to attenuate by means of normal muffling devices.

The invention is based on a recognition of the different nature of the truck exhaust pulse and provides a means to convert that pulse into one that has a significantly lower DB level. In doing this, points of maximum and minimum relative compliance for the exhaust system are determined and, commencing at the upstream portion, pulse conversion is obtained by placing acoustical inertance means at the points of maximum compliance and acoustical compliance means at the points of minimum compliance. Thus, generally, the invention provides a pulse converter in the form of a relatively small and simple acoustic device for the insertion in the portion of the exhaust system downstream of the manifold to convert unfavorable engine exhaust pressure pulses into more favorable pulses downstream of the pulse converter and at the end of the exhaust pipe, preferably to remove enough acoustic energy so that the noise level of the engine is acceptable.

OBJECTS

Accordingly, it is one object of the present invention to provide an improved exhaust muffler system;

It is another object of the present invention to provide an improved muffler system for truck use;

It is a further object of the present invention to provide an improved muffler system for diesel powered trucks;

It is another object of the present invention to provide an improved muffler having an annular peripheral flow through at least a portion thereof;

It is still a further object of the present invention to provide an improved muffler system including a manifold volume mounted adjacent the manifold of a truck engine;

It is still another objct of the present invention to provide an improved peripheral flow muffler system for truck exhausts;

It is another object of the present invention to provide an improved tuned muffler system for heavy duty truck exhaust systems.

Further objects, features and advantages of the present invention will become apparent from a detailed study of the attached drawings described above and the following specification and claims.

DESCRIPTION OF THE INVENTION

Figure 1:
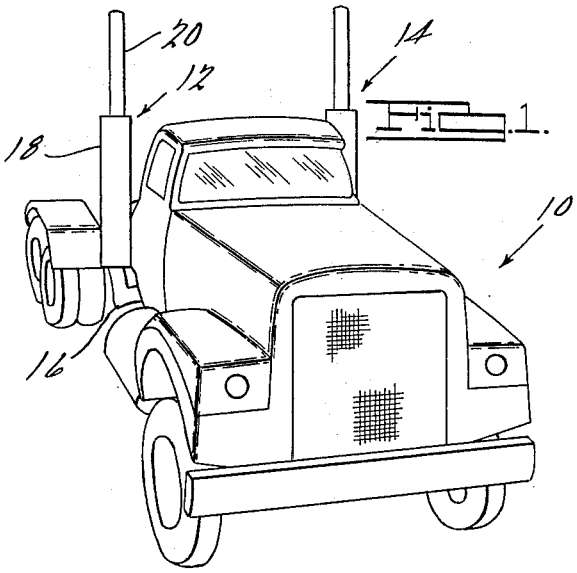
FIG. 1 is a perspective view of a tractor having a dual exhaust system utilizing general principles of this invention. and not illustrating the manifold volume forming part of the system.

FIG. 1 illustrates a diesel tractor 10 having a dual exhaust system including a right side muffler assembly 12 and a left side muffler assembly 14. The right muffler system 12 consists of a manifold volume (not seen), a silencer system 18, a preferred silencer system being best illustrated in FIGS. 2 and 3, and a straight pipe section 20. The left side 14 is substantially identical to the right side 12. It is the manifold volume and silencer assembly 18 with which the invention of this application is primarily concerned.

Figure 3:
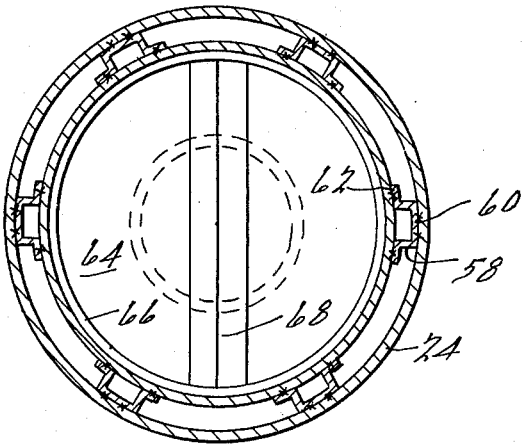
FIG. 3 is a sectional view of FIG. 2 taken along line 3—3 thereof and particularly illustrating the interconnection of the inner shell with the outer shell to form a peripheral annular flow path for the exhaust gas.
Figure 2:
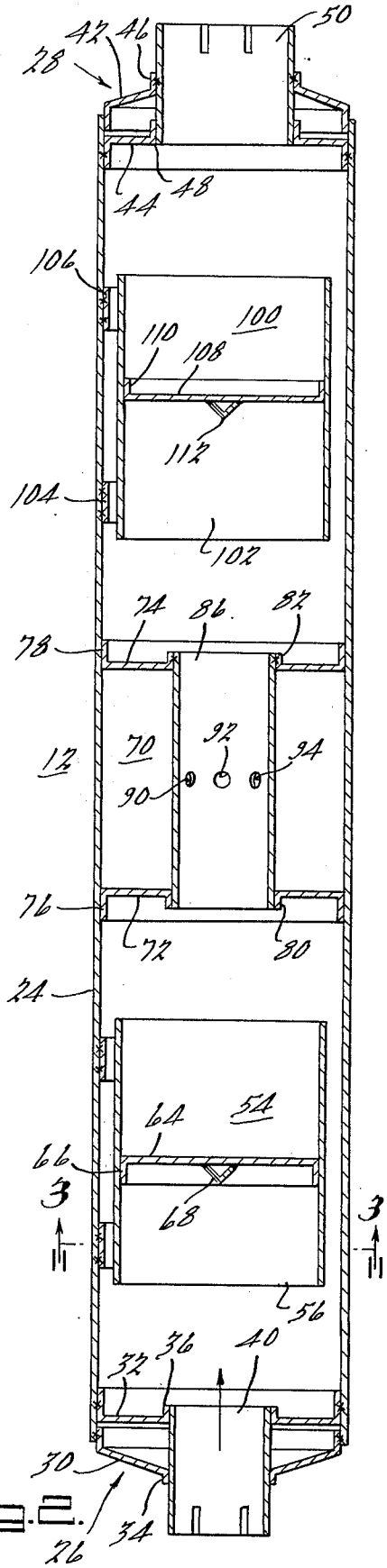
FIG. 2 is a sectional view of a preferred form of a portion of the exhaust system of the present invention and particularly illustrating the compliance and inertance parts thereof.

Referring now to FIGS. 2 and 3, there is illustrated a silencer assembly which is a preferred form of silencer assembly to be used in conjunction with the tractor 10 and illustrated at 12 and 14. The silencer assembly includes an outer shell 24 which is closed at either end and is preferably circular in cross-section, for example, being a 9 inch tubular structure having an overall length of 47 inches. The opposite ends of the shell 24 are closed by inlet and outlet headers 26, 28 respectively, which are interconnected with the ends of the shell by suitable welding processes. For example, certain of the parts of the headers 26, 28 may be spot welded or MIG welded to other parts of the silencer.

Referring particularly to the inlet header 26, the header is reinforced to resist the effects of extremely high pressures created by the exhaust gases by means of transverse partitions 30, 32 which are seam and spot welded, respectively, to the outer shell 24. The central portion of the transverse partitions 30, 32 are provided with aligned apertures formed by flanges 34, 36 respectively, which are adapted to receive a tubular member 40, the tubular member 40 having a diameter consistent with the diameter of the pipe to which the assembly 12 is to be attached. In one preferred form of silencer assembly, the tube 40 has an inside diameter of 3.50 inches and a length of 4.69 inches. The partition 30 is slightly bell shaped to permit attachment of the flange 34 thereto adjacent a central or outer portion of the exterior surface of the tube 40. Further, the bell shaped partition 30 also provides a baffle for any ringing vibration which may occur in partition 32 due to the pressures encountered within the interior of the shell 24.

The outlet header assembly 28 is similarly constructed to include an outer partition 42 and an inner partition 44 which are attached to the interior surface of the tubular housing 24 by seam and spot welding, respectively. Similarly, the partitions 42, 44 are provided with aligned apertures at the central portion thereof formed by axially extending flanges 46, 48 adapted to be attached to a tubular member 50, the tubular member being sized to be attached to the upstanding pipe section 20 described in conjunction with FIG. 1. In a preferred form of the invention, the tubular member 50 has an inside diameter of 5.00 inches and a length of 4.69 inches. In the embodiment illustrated, the tubular member 50 is axially aligned with the tubular member 40 to provide an in line attachment to the upstanding pipe from the upstanding pipe attached to the manifold volume. These attachments are made by standard clamps as are commonly used in this art.

As the gases proceed into the inlet header 26, the first pulse section converter encountered which is generally 54 is illustrated as two relative large volume chambers connected by a small area peripheral passage between the outer shell 24 and an inner shell 56. The two open volumes are formed in section 54 by means of the inner shell 56, which, when positioned in the section 54, forms an annular peripheral flow of gases from the first volume to the second. Thus, the pulse converter 54 comprises two compliances connected by an inertance formed by the annular peripheral passageway. The inner shell 56 is, in the preferred form, a circular tube having an outside diameter of 7.62 inches and a length of 9.38 inches. The inner shell 56, as best seen in FIG. 3, is attached to the outer shell 24 by means of a plurality of hat-shaped clip elements 58 positioned around the outside diameter of the shell 56 at approximately 60° intervals. The hat-shaped elements are attached to the outer shell 24 at the crown 60 thereof by means of spot welding and to the inner shell 56 by means of a flange 62 to the inner shell by spot welding. As a modified form of attachment, the hat-shaped clips may be eliminated and tabs formed from the body of the inner shell 56, the tabs extending outwardly from the outside diameter thereof and attached to the inside diameter of the outer shell 24 by spot welding. It may be necessary to form flanges on the ends of the tabs.

The interior of the inner shell 56 is closed by means of an inner baffle 64 which is circular in shape and has an axially extending annular flange 66 formed at the outer edge thereof. The flange 66 is attached to the inside diameter of the shell 56 by spot welding. In order to eliminate any ringing vibration by the baffle 64 and to provide further stiffening for the baffle 64, a fillet 68 is welded to the central portion of the baffle 64 and extends across the entire diameter of the baffle 64. In the preferred form, the fillet is formed by bending a strip of metal to form two ¾ inch legs.

The next section encountered by the gases flowing through the outer shell 24 is an inertance section 70 which also includes a tuner tuned to certain frequencies encountered within the inertance section 70. The inertance section 70 is formed by two partitions 72, 74, the partitions being formed as circular discs having an external axially extending flange 76, 78 respectively, formed thereon and an internal, axially extending flange 80, 82 formed at the interior thereof. The internal flanges 80, 82 form aligned apertures which are adapted to receive an inner shell 86 supported between the baffles 72, 74. The inner shell 86 is attached to the flanges 80, 82 by spot welding as is the case of the attachment of the annular flanges 76, 78 to the outer shell 24. The inner shell 86 is, in the preferred form, a tube having an outside diameter of 3.50 inches and a length of 9.3 inches. The tuning is accomplished by forming three apertures 90, 92, 94 therein, the apertures being positioned 120° apart and having a diameter of 0.38 inch.

The space between the outer shell 24 and the inner shell 86 forms an annular cavity or dead air space which, in combination with the gases flowing through the tube 86 and the apertures 90, 92, 94, form a tuning element for certain frequencies occurring at the inertance section 70. It is to be understood that the diameter of the tube 86 and the size of apertures 90, 92, 94 may be varied to tune for other frequencies as is common in the acoustical art.

The final section within the silencer assembly 12 is a second pulse converter section 100, the section 100 being formed substantially identical to the section 54 with the exception of the direction of the attachment flange for the interior baffle. Particularly, the section 100 is formed by first and second large volumes within the outer shell 24, the volumes being connected by means of an annular, peripheral passageway for the flow of gases. The peripheral flow path is formed by an imperforate shell 102 spaced from the inner wall of the outer shell 24. As was the case with the shell 56, the inner shell assembly is provided with a plurality of hat-shaped clip members 104, 106 which take the form illustrated in FIG. 3. Again, the hat-shaped elements are positioned 60° apart.

The interior of the shell 102 is closed by means of a partition or bafle member 108 which is formed as a disc having an annular flange 110 formed at the outer rim thereof. An angular fillet 112 is welded across the face of the baffle 108 and extends across the entire diameter thereof, the fillet being formed as an angle as was the case with fillet 68. Again, this prevents ringing of the partition 108 and further stiffens the partition 108. Thus, the pulse converter section 100 is formed by two compliance sections connected by an annular peripheral passageway forming an inertance. It is also to be noted that the tuner-inertance section 70 with the two volumes at either end thereof (the right and left volumes of pulse converter sections 54 and 100 respectively), form a central pulse converter section.

Figure 4:
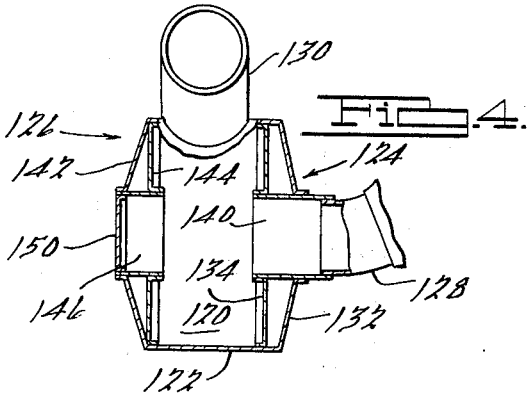
FIG. 4 is a sectional view of another portion of the silencing system and particularly illustrating the manifold volume portion thereof which is positioned adjacent the exhaust manifold of the truck.

Referring now to FIG. 4, there is illustrated the manifold volume structure which is positioned between the manifold and the silencer system of muffler assembly 14. The manifold volume 120 illustrated in FIG. 4 is adapted to be utilized on the left side of the exhaust system and a corresponding right side manifold volume is also provided. Referring to the particular details thereof, the manifold volume comprises an outer shell 122 which, in the preferred embodiment, is a tubular structure having an outside diameter of approximately 9.00 inches and a length of 4.00 inches. The ends of the tube 122 are closed by header assemblies 124, 126 which are constructed substantially similar to the headers 26, 28 described in conjunction with FIG. 2. The inlet to the manifold volume 120 is by means of an outwardly flanged tube assembly 128 which is attached to the manifold of the truck. The manifold volume 120 is attached to the silencer assemmbly (FIG. 2) by means of a 90° elbow tube 130 which is attached to the outer shell 122 by welding and is attached to the connecting pipes for the muffler assembly by any suitable collar type clamps. It is to be noted that the manifold volume 120 is not visible in FIG. 1 due to the fact that the manifold volume 120 is positioned closely adjacent the manifold of the truck.

As was the case with FIG. 2, the end of the shell 122 is closed by a header 124 which comprises a pair of partitions 132, 134, the partitions being formed with flanges at the outer extremities thereof, which flanges are welded to the interior surface of the shell 122. The central portion of the partitions 132, 134 are similarly formed with axially extending flanges which form aligned apertures which are adapted to receive a tube 140. The tube 140 is welded to the interior flanges of the partitions 132, 134. As was the case with FIG. 2, the partition 132 is bell shaped to provide a more rigid attachment of the tube 140 to the shell 22.

The header assembly 126 is similarly formed as was the header 124 with a pair of partitions 142, 144. Again, the partitions are formed with annular flanges at the exterior thereof for attachment to the shell 122 and at the interior thereof to form aligned apertures to receive a tubular structure 146. The tubular structure 146 is, as was the case with tube 140, formed with an inside diameter of 3.50 inches. The tube 146 is of sufficient length to traverse the distance between the interior flanges of partitions 142, 144 and the open end of the tube is closed by means of a plug 150. Portions of manifold volume 120 may be suitably shielded to preclude any ringing vibration from the manifold volume 120 to the atmosphere, which shielding would reduce any noise level created by ringing vibrations of portions of the manifold volume 120.

As stated above, in normal engineering of an exhaust system to achieve silencing, the nodal characteristics of the pipe are determined and silencing devices are arranged in accordance with this information to attenuate the troublesome notes in accordance with the standing wave theory of acoustics. The pulse characteristics of certain engines, especially diesel engines such as are used in trucks, preclude this approach and require other systems of determining pipe characteristics as pointed out in some detail in U.S. Pat. No. 3,807,527, issued Apr. 30, 1974 for "Pulse Converter For Exhaust System," and assigned to the assignee of the instant application, the disclosure of that patent being incorporated herein by reference. We have discovered that instead of conventional acoustical engineering theories, it is better to determine the points of maximum and minimum compliance along the length of the exhaust system and achieve silencing by positioning inertance devices at one or more of the maximum compliance points and compliance devices at one or more of the minimum compliance points. In the above-cited patent, there is described a method of doing this utilizing a probe microphone and an oscilloscope to determine peak pressure readings and pulse widths. This information revealed the relative compliance at various stations along the length of the exhaust system.

In the case of the preferred embodiment of the invention, a pressure and pulse width graph was evolved in accordance with the teachings of the above-referenced patent by sensing pressure and pulse duration at various points along the length of a 3.50 inches O.D. straight pipe, 130 inches long, attached to the exhaust manifold of a diesel engine of a 1972 International Harvester, cab-over engine tractor, the engine being designated 8 V 71 w/N65 and being operated in a substantially loaded condition at 2205 RPM. The pulse height graph, representing the pressure readings along the length of the pipe, did not display the normal nodal structure or shape obtained with conventional four-cycle piston engines. The pulse has maximum pressures much higher than conventional engines and it substantially fills the pipe and is more or less N-shaped. It is believed that similar pulse characteristics will be obtained with other two-cycle piston engines.

In normal engineering of an exhaust system to achieve silencing, the nodal characteristics of the pipe are determined and silencing devices are arranged in accordance with this information to attenuate the few troublesome notes as per the standing wave theory. The truck engine pulse characteristics preclude this approach and require another. In accordance with the present invention, openings are formed in a standard diameter exhaust system straight pipe conduit at numerous regular intervals along its length and probes are mounted on the pipe at the openings. The pipe is attached to the exhaust manifold and the engine operated, preferably, under the worst silencing conditions that are encountered in normal operation of the engine (e.g., when the pulse fills the entire pipe). A probe microphone is attached in turn to each of the spaced openings or stations to obtain pressure pulse oscilloscope photos. Each of these gives a peak pressure reading in terms of microphone voltage and a pulse width in terms of milliseconds of time. By comparing the readings at successive stations, pulse peak voltage (or pressure) and pulse width for each station is obtained. The change in pressure between two adjacent stations and the change in pulse width between two adjacent stations is useful data, characteristic of the engine being studied. The ratio of pipe compliance to pulse flow between adjacent stations is proportional to the ratio of the change in pulse width to the change in pulse pressure between these stations. Therefore, the readings taken reveal the relative compliance at the various stations along the length of the exhaust system.

After the maximum and minimum compliance points are calculated by the method disclosed in the aforementioned patent, compliances and inertances may be positioned at the points of minimum and maximum compliance, respectively. At the low peaks where compliance is a minimum, the pipe apears to the pulse as being necked down or reduced in diameter. At the high peaks where the compliance is a maximum, the pipe appears to be enlarged. In accordance with the invention, volume sections or compliances, such as the two compliance volumes found in each of the pulse converters 54 and 100, in FIG. 2, are inserted in the exhaust system at points of minimum compliance and an inertance, such as portion 70, or the peripheral, annular passageway, in FIG. 2, is inserted in the system at one or more points of maximum compliance.

It is to be understood that the curves for the pressure and pulse width is plotted for a straight pipe and provides an excellent approximation for the placement of the compliance and inertance portions. Upon placing the silencing system on the manifold, these points may vary slightly and require fine adjustment of the final position of these compliance and inertance portions.

In calculating the compliance points for the above described truck engine, it was discovered that a further low compliance point exists very near the manifold and it has been found that the insertion of a compliance element, such as the manifold volume illustrated in FIG. 4, enhances the reduction of noise level emitting from the end of the pipe. This manifold volume is not visible in FIG. 1 as it would be positioned in the engine compartment or very near thereto.

Another system for determining the maximum and minimum compliance points in a straight pipe attached to the engine and operated as described above is disclosed in U.S. Pat. No. 3,853,200, issued Dec. 10, 1974, for "Method of Determining Compliance Poles," and assigned to the assignee of the instant invention. This disclosure is also incorporated herein by reference. In that disclosure, it is disclosed that a temperature profile of the exhaust system can be used to substantially indicate the location of maximum and minimum compliance points of the system. Again, a 130 inches straight pipe was used to provide the location of the points.

In this system used to evolve a temperature versus distance from the manifold or the end of the pipe, the straight pipe used to evolve the graphs is used wherein the series of openings along its entire length serve to receive temperature sensing devices or probes whereby the temperature at many stations along the length of the pipe, and thus the system, can be determined. The temperature openings commence adjacent the end of the pipe at the downstream end of the system and terminate at the manifold.

In generalized form, the temperature inside the exhaust system decreases in a substantially linear trend from the upstream end to the downstream end of the pipe. This line may be determined by measuring and plotting the temperatures a the inlet and outlet ends of the system. Normally, the slope of the line is in the order of 5° per foot depending upon the type of engine, engine speed, engine load, pipe or system characteristics, and other factors.

Various phenomena, however, seem to affect the temperature at certain points in the system and variations of 20° F or more from the linear may exist. These are called thermal anomalies. Thus, at some locations the temperature is higher than the linear dotted curve to provide a positive thermal anomaly, and in other cases the temperature is below the linear curve to provide a negative thermal anomaly. It was found that the positive anomalies exist in the vicinity of increased acoustical pressure or gas flow compression, and that negative anomalies exist in the regions of decreased acoustical pressure or flow expansion. These temperature effects are therefore related to the maximum and minimum compliance points that are described in more detail above. The positive anomalies correspond to inertance poles or minimum compliance points where there is a rapid compression or increase in pressure over a short length of pipe that is reflected as a localized increase in temperature. The negative anomalies are found where there is a rapid expansion or reduction in pressure that is reflected as a temperature decrease. The greater the temperature deviation from the linear dotted curve in a short length of pipe the more significant is the compliance or inertance information at that point. Some systems produce larger deviations or anomalies in short sections of pipe than others and these are most useful as data for the exhaust system engineer.

The positive points correspond to minimum compliance (maximum inertance) poles in the system and the negative point corresponds to a maximum compliance point for the system. It is to be noted that a positive anomaly occurs very near the manifold indicating a minimum compliance point at which the manifold volume is placed. Again, the curve illustrates the temperature variations in a 130 inches straight pipe. The insertion of the silencer and manifold volume may slightly vary these points to require fine adjustment of the elements 54, 70, 100 and 120 to achieve the best results.

This system therefore provides a method that may be used by the engineer to attenuate sound or audible notes in the acoustic pulsations of a heated gas flow system such as a truck exhaust system. In applying the temperature method, the source of gas is operated at the highest sound pressure or under conditions that create the most troublesome silencing problems. A uniform diameter straight pipe is used for the exhaust or flow system, and the temperatures are measured along its length and plotted as described above to obtain a characteristic temperature profile. The main positive deviations from a straight line temperature gradient, representing a linear change between the inlet and outlet of the system, correspond to low compliance points and the main negative deviations correspond to high compliance points. One or more compliance and inertance devices are then placed in the system substantially at the low and high points, respectively. These devices appear to break up high energy pulses or shock waves to produce attenuation. If desired, additional silencing means (not shown in the system) may be used downstream of device 18. This may be of conventional design since the compliance and inertance devices produce wave forms that are amenable to attenuation by standard structures and techniques.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. A pulse converter for attenuating sound in pulsating gas flow such as the exhaust gas from a truck engine comprising tabular elongated outer shell of substantially uniform cross section along its entire length and having an inlet end wall at one end and an outlet end wall at the other end, said inlet end wall having an inlet for incoming gas and said outlet end wall having an outlet for outgoing gas, a first tubular elongated inner shell of substantially uniform cross section along its entire length and open at each end, means supporting said first shell in unobstructed alignment with said inlet and so that its entire outer periphery is spaced radially inwardly from the outer shell to define a first annular elongated passage between the outer shell and the first inner shell, said first inner shell having a transverse wall therein at a central location along its length to block gas flow through the first inner shell, said first annular elongated passage being substantially less in cross sectional area than the first inner shell and forming a first peripheral inertance gas flow passage through which gas must flow to pass from the upstream end of the first inner shell to the downstream end of the first inner shell, a second tubular elongated inner shell of substantially uniform cross section along its entire length and open at each end, means supporting said second shell in alignment with said outlet and so that its entire outer periphery is spaced radially inwardly from the outer shell to define a second annular elongated passage between the outer shell and the first inner shell, said second inner shell having a transverse wall therein at a central location along its length to block gas flow through the second inner shell, said second annular elongated passage being substantially less in cross sectional area than the cross sectional area of the second inner shell and forming a second peripheral inertance gas flow passage through which gas must flow to pass from the upstream end of the second inner shell to the downstream end of the second inner shell, the upstream end of the first inner shell being longitudinally spaced downstream from said inlet and the downstream end of the second inner shell being longitudinally spaced upstream from said outlet, substantially the entire cross sectional area of the outer shell along the length thereof between said inlet and the upstream end of the first inner shell forming a gas flow passage for the flow of gas from the inlet to the first inner shell and to the first peripheral inertance passage.

2. A converter as set forth in claim 1 including a pair of transverse walls located between and spaced longitudinally from said first and second inner shells and extending across said outer shell and secured thereto, an elongated gas flow tube open at each end and unobstructed to gas flow throughout its length and supported at its opposite ends in said transverse walls, the space between said transverse partitions and between the gas flow tube and outer shell forming an annular sound attenuating chamber, said gas flow tube having openings in the wall thereto to connect said chamber to the inside of the tube.

3. In an exhaust system for silencing the combustion engine of a truck, a housing having an inlet and an outlet and providing a compliance volume between the inlet and outlet, said housing being located adjacent the engine manifold at a minimum compliance point in the exhaust system and having its inlet connected to receive exhaust gas discharged from said manifold, said exhaust system including a pulse converter connected to the outlet of said housing to receive gas therefrom, said pulse converter comprising a tubular elongated outer shell of substantially uniform cross section along its entire length and having an inlet end wall at one end and an outlet end wall at the other end, said inlet end wall having an inlet for incoming gas and said outlet end wall having an outlet for outgoing gas, a first tubular elongated inner shell of substantially uniform cross section along its entire length and open at each end, means supporting said first shell in unobstructed alignment with said inlet and so that its entire outer periphery is spaced radially inwardly from the outer shell to define a first annular elongated passage between the outer shell and the first inner shell, said first inner shell having a transverse wall therein at a central location along its length to block gas flow through the first inner shell, said first annular elongated passage being substantially less in cross sectional area than the first inner shell and forming a first peripheral inertance gas flow passage through which gas must flow to pass from the upstream end of the first inner shell to the downstream end of the first inner shell, a second tubular elongated inner shell of substantially uniform cross section along its entire length and open at each end, means supporting said second shell in alignment with said outlet and so that its entire outer periphery is spaced radially inwardly from the outer shell to define a second annular elongated passage between the outer shell and the first inner shell, said second inner shell having a transverse wall therein at a central location along its length to block gas flow through the second inner shell, said second annular elongated passage being substantially less in cross sectional area than the cross sectional area of the second inner shell and forming a second peripheral inertance gas flow passage through which gas must flow to pass from the upstream end of the second inner shell to the downstream end of the second inner shell, the upstream end of the first inner shell being longitudinally spaced downstream from said inlet and the downstream end of the second inner shell being longitudinally spaced upstream from said outlet, substantially the entire cross sectional area of the outer shell along the length thereof between said inlet and the upstream end of the first inner shell forming a gas flow passage for the flow of gas from the inlet to the first inner shell and to the first peripheral inertance passage.

* * * * *